US005121032A

United States Patent [19]

Han

[11] Patent Number: 5,121,032

[45] Date of Patent: Jun. 9, 1992

[54] POWER SUPPLY FOR TURNING ON SMALL FLUORESCENT LIGHT OF LIQUID CRYSTAL DISPLAY TV

[75] Inventor: Kwanyoung Han, Suwon, Rep. of Korea

[73] Assignee: Samsung Electronics Co., Ltd., Suwon, Kuwait

[21] Appl. No.: 448,934

[22] Filed: Dec. 12, 1989

[30] Foreign Application Priority Data

Dec. 12, 1988 [KR] Rep. of Korea ..... 88-20488

[51] Int. Cl.[5] ..... H05B 41/36

[52] U.S. Cl. ..... 315/219; 315/DIG. 7; 331/113 A

[58] Field of Search ..... 315/219, DIG. 7; 363/131; 331/113 A

[56] References Cited

U.S. PATENT DOCUMENTS 3,691,450 9/1972 Cox ..... 315/219
3,863,180 1/1975 Parson ..... 331/113 A
3,973,165 8/1976 Hester ..... 331/113 A
4,051,413 9/1977 Abadié ..... 315/219
4,184,128 1/1980 Nilssen ..... 331/113 A
4,700,112 10/1987 Chang ..... 331/113 A

*Primary Examiner*—Eugene R. LaRoche
*Assistant Examiner*—Son Dinh
*Attorney, Agent, or Firm*—Christie, Parker & Hale

[57] ABSTRACT

A small fluorescent light turning on power supply device for a liquid crystal TV for operating the back light of the liquid crystal display TV. The invention is characterized in that a resonance type turning capacitor $C_S$ is connected to the light for preventing continuous electric power consumption, coil $L_{dc}$ is connected between a power supply source and a filter resistor $R_S$ is connected to switching elements, and a capacitor C is connected between the collectors of said two switching elements. According to the invention, an economical small resonance type current source power supply device which is free of noise and switching stress and simultaneously reduces electric power loss to a minimum, can be obtained.

3 Claims, 6 Drawing Sheets

POWER SUPPLY FOR TURNING ON SMALL FLUORESCENT LIGHT OF LIQUID CRYSTAL DISPLAY TV

BACKGROUND OF THE INVENTION

The present invention relates to a power supply device for operating the back light of a liquid crystal display TV, and more particularly, to a device for supplying power to a small fluorescent light of a liquid crystal display TV such that after starting the back light, said light emits continuously without any noise generating therefrom and any variation of voltage source.

Heretofore, as shown in FIG. 1, in case of a push-pull voltage source converter type, when switching transistors $TR_1$, $TR_2$ are operated to ON/OFF, the switching voltage and current wave as shown in FIGS. 2(A) and 2(B) are transferred to load $R_L$ through transformer T.

At this moment, when said transformer T is an ideal transformer, switching operation of said transistors $TR_1$, $TR_2$ may be satisfied if controlled by a desired frequency from the exterior, however in this case, some switching control circuit means from the exterior is required additionally and the system becomes complicated, and therefore, it is disadvantageous and uneconomical for a device of small capacity such as liquid crystal display TV.

Further, in case of driving said switching transistors, an output voltage of alternating current can be obtained in case when switching operation is carried out by self oscillation, however, since the saturating property of the transformer is utilized, there is disadvantage that consuming electric power is larger.

That is, said switching operation is started after the power supply voltage $V_S$ is passed through resistor $R_S$, and when the switching transister $TR_1$ becomes conductive, voltage is applied to the transformer T and magnetic flux becomes increased and the transformer becomes saturated.

Therefore, primary current of the transformer T is rapidly increased, driving current is rapidly decreased and said transistor $TR_1$ becomes OFF, consequently the voltage becomes inverted by magnetic current of said transformer T and making the transistor $TR_2$ to be ON, and switching operation becomes repeated by operating principle of transformer as same as the operation of said transistor $TR_1$, whereby output voltage and output current of square waves as shown in FIGS. 2(A), 2(B), 3(A), 3(B), 3(C) and 4 are produced, and therefore, there is disadvantage that consuming electric power is rapidly increased due to saturation of said transformer.

Said FIGS. 2(A) and 2(B) show the switching voltage and current wave forms in accordance with ON/OFF operation of transistors $TR_1$, $TR_2$, FIGS. 3(A) and 3(B) show switching voltage (FIG. 3(A)) and current (FIG. 3(B)) wave form in response to the load $R_L$ in the case when self-oscillating is occuring, FIG. 3(C) shows the respective cases of fully loaded and not loaded about a variable load, and FIG. 4 shows the output voltage and output current in response to the variation of the load, wherein the waveforms of $V_0$, $I_{L1}$ show the respective output voltage and current from the load in the case where the load has resistive and inductive components, and the waveform of $I_{L2}$ shows the output current from the load in the case where the load has resistive and capacitive components.

FIG. 5 shows a conventional current source converter circuit, in which a power supply voltage $V_s$ is applied through coil $L_{dc}$ to the primary side of a transformer T, and when switching transistor $TR_1$ is operated by a driving circuit, current is induced at the secondary side of said transformer T, according to said load $R_L$, voltage and current applied over both end terminals of said transistor $TR_1$ becomes to be as shown in FIGS. 6(A) and 6(B).

Further, switching the output voltage and current in response to the variation of said load are exhibited as voltage $V_{01}$ and current $I_L$ from the load in the case where the load has resistive and inductive components as well as voltage $V_{02}$ of the load in the case where the load has resistive and capacitive components as shown in FIG. 7.

However, since such current source converter utilizes also the characteristic that the transformer is saturated when executing operation, not only electric power loss at the transformer is large, but also particularly when switching, switching stress of the switching element is great and switching loss is also great, consequently high frequently raising and dropping are extremely limited and noise problem is much, and therefore, there is a problem that use is not suitable even for small liquid crystal display TV.

SUMMARY OF THE INVENTION

Therefore, the present invention is invented to solve such disadvantages, and it is an object of the present invention to provide a power supply device for turning on a small fluorescent light of a liquid crstal display TV for eliminating influence of noise by organizing resonance type current source inverter circuit, and preventing switching stress and electric power loss.

In order to accomplish such object as above, the present invention is constituted such that a capacitor $C_S$ is connected between the load and transformer, a capacitor C is connected between the collectors of respective two transitors Q1 and Q2, and a resonance coil $L_{dc}$ is connected between power supply terminal and resistor $R_S$.

The foregoing and other objects as well as advantages of the present invention will become clear by the following description of the invention with reference to the accompanying drawings.

BRIEF DESCRIPTION OF THE DRAWINGS

For a better understanding of the invention, and to show how the same may be carried out into effect, reference will now be made, by way of example, with respect to the accompanying drawings, in which.

Throughout the drawings, like reference numerals and symbols are used for designating like or equivalent parts or portions, for simplicity of illustration and explanation.

DETAILED DESCRIPTION OF THE INVENTION

Hereinafter, the present invention will be described in detail with reference to the accompanying drawings.

Figure 1:
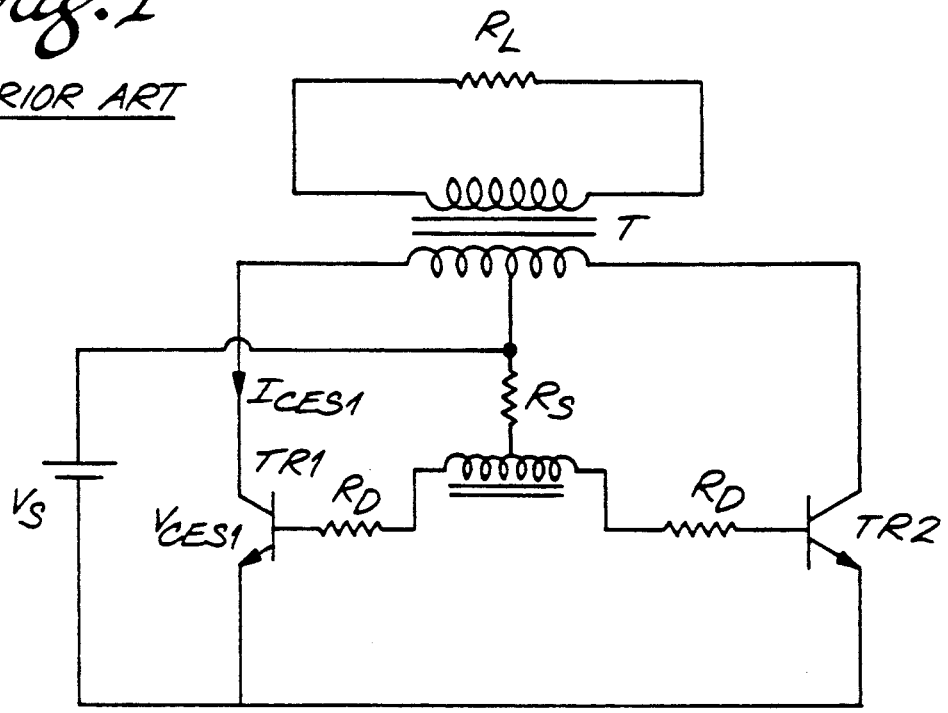
Fig. 1 PRIOR ART
FIG. 1 is a circuit diagram of a conventional voltage source converter.
Figure 2A:
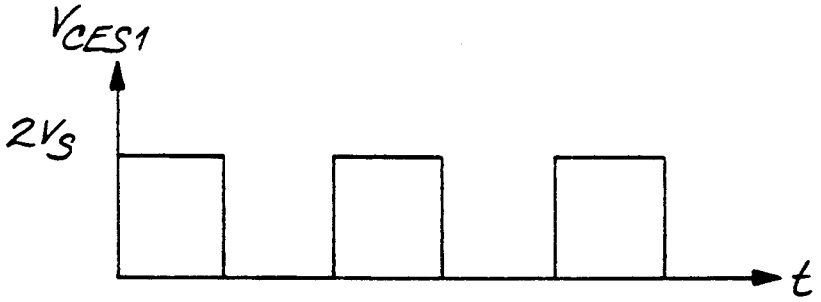
Fig. 2a PRIOR ART
FIGS. 2(A) and 2(B) are wave form charts of voltage and current according to the conventionl switching operation.
Figure 2B:
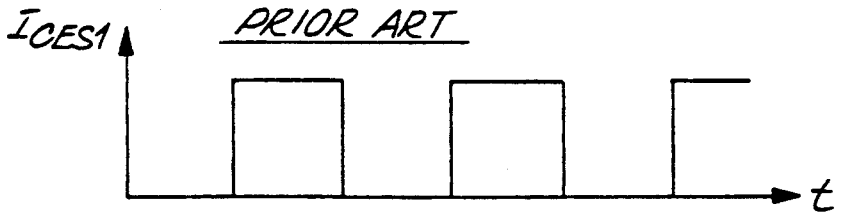
Fig. 2b PRIOR ART
Figure 3A:
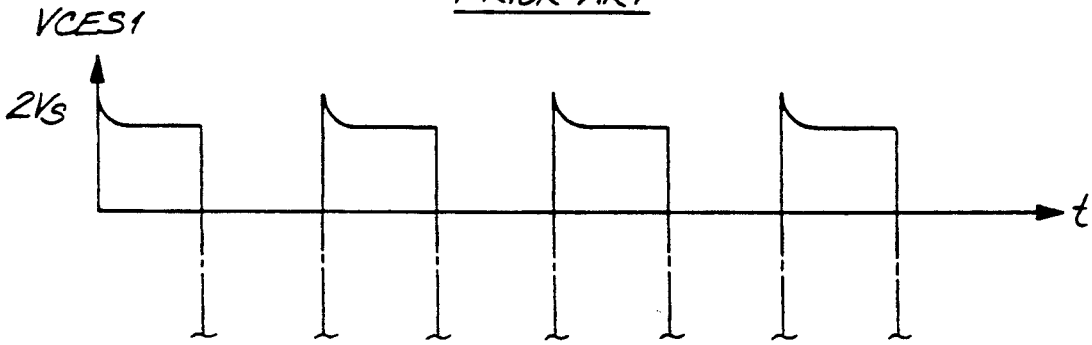
Fig. 3a PRIOR ART
FIGS. 3(A) to 3(C) are wave form charts of voltage and current of switching in accordance with the load in case of the conventional oscillation device.
Figure 3B:
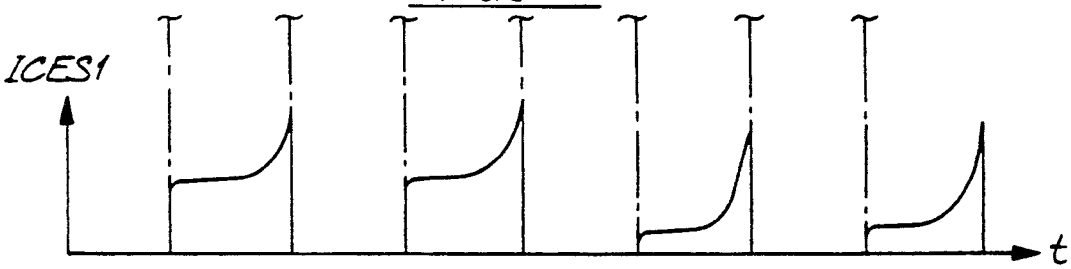
Fig. 3b PRIOR ART
Figure 3C:
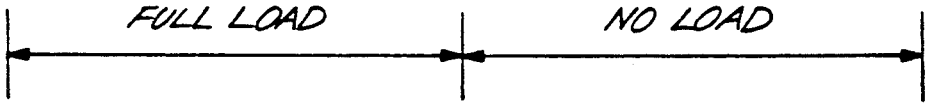
Fig. 3c PRIOR ART
Figure 4:
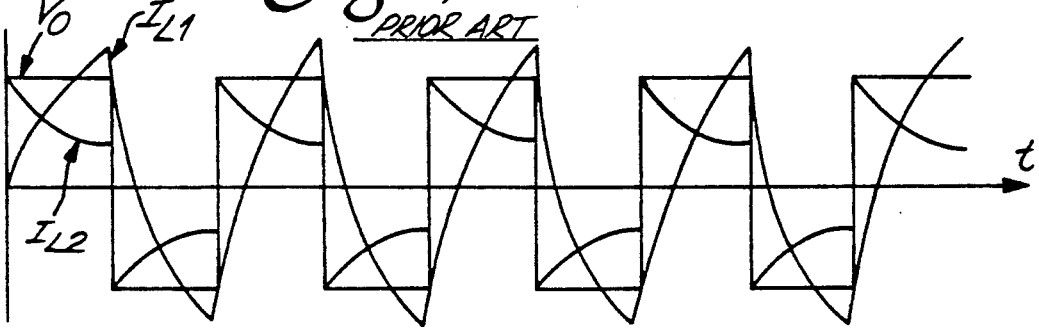
Fig. 4 PRIOR ART
FIG. 4 is a wave form chart of output voltage and current according to the conventional load variation.
Figure 5:
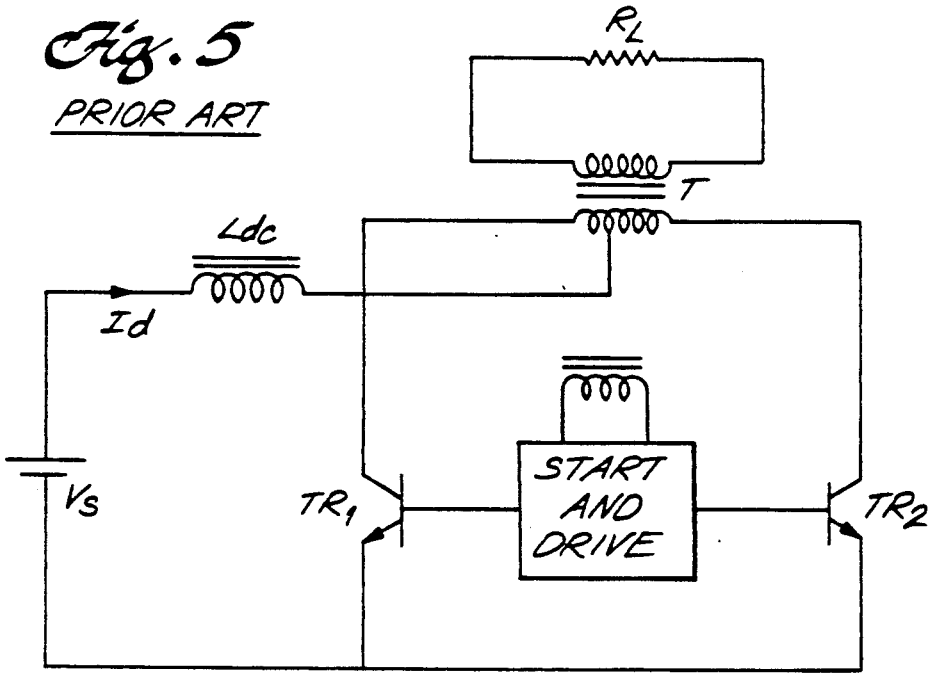
Fig. 5 PRIOR ART
FIG. 5 is a circuit diagram of a conventional current source converter.
Figure 6A:
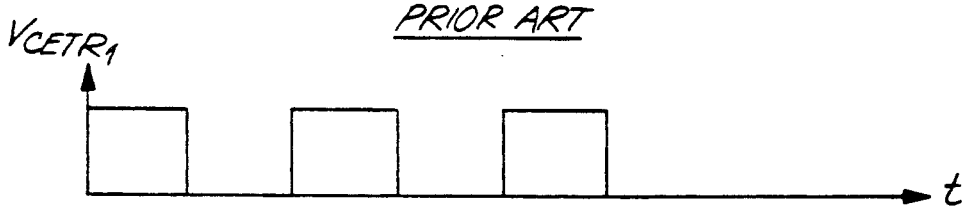
Fig. 6a PRIOR ART
FIGS. 6(A) and 6(B) are wave form charts of voltage and current applied to a switching transistor in case of the conventional current source resistor $R_L$ load.
Figure 6B:
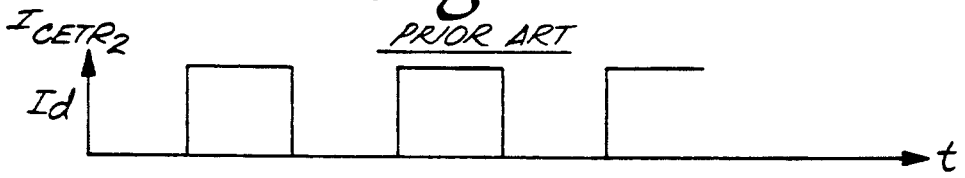
Fig. 6b PRIOR ART
Figure 7:
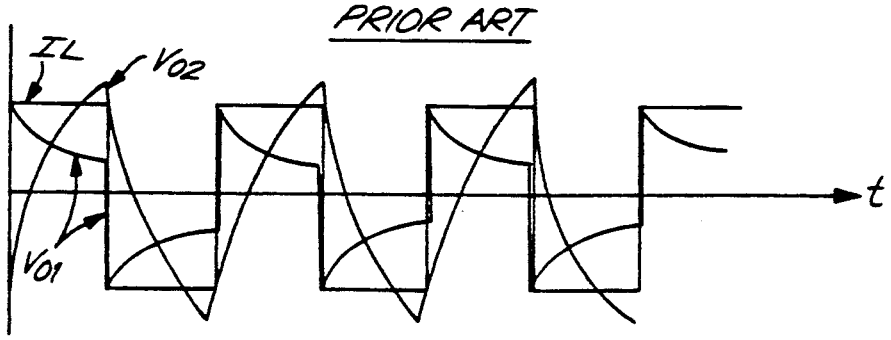
Fig. 7 PRIOR ART
FIG. 7 is a wave form chart of voltage and current in accodance with the load variation of the conventional current source.
Figure 8:
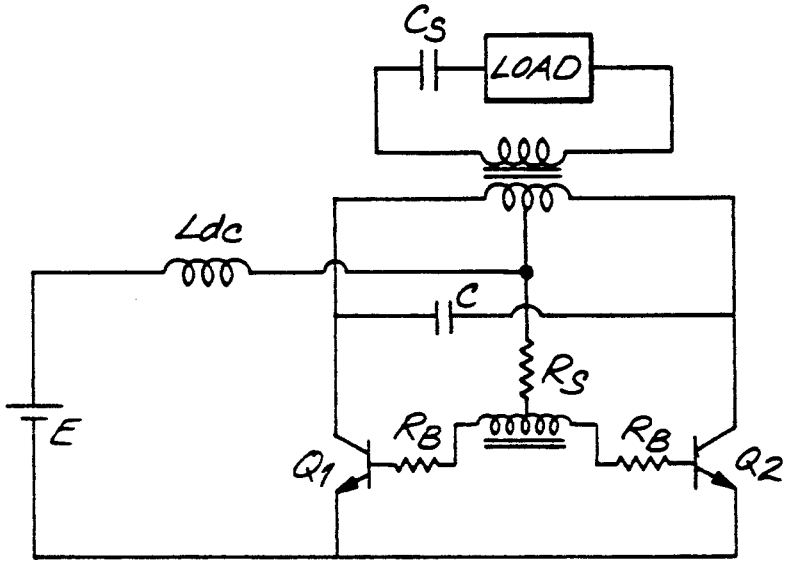
FIG. 8 is a circuit diagram of a resonance type current source inverter of a preferred embodiment of the present invention.
Figure 9A:
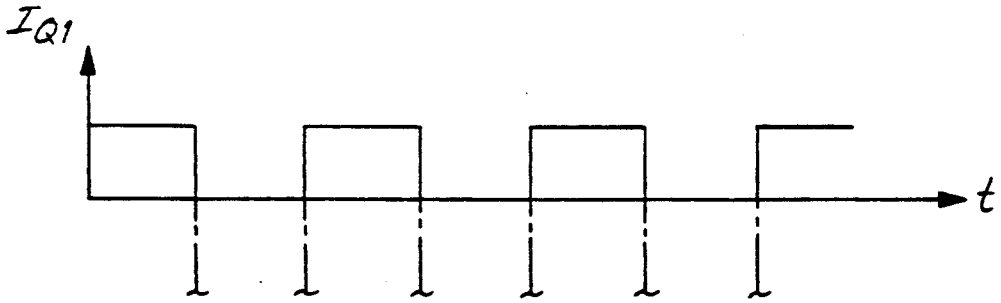
FIGS. 9(A) and 9(B) are wave form charts of switching voltage and current according to the present invention.
Figure 9B:
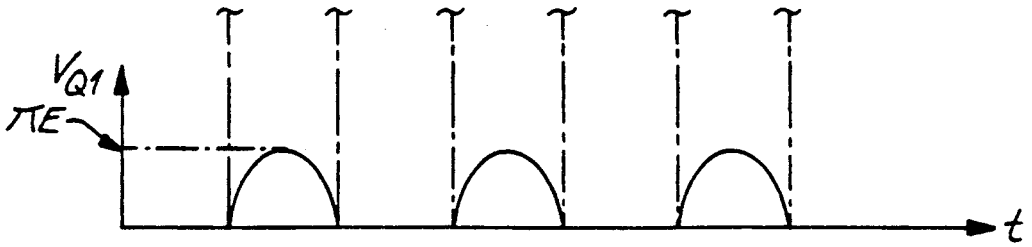

FIG. 8 shows a circuit of the resonance type current source inverter of the present invention. When a power supply voltage E is applied to each base of switching transistors Q1, Q2 through a resonance coil $L_{dc}$ and resistors $R_S$, $R_B$, said switching operation becomes ON/OFF alternately and producing high frequency. The current and voltage characteristics applied over said switching transistors in the time when switching operation of said respective transistors Q1 and Q2 become ON/OFF alternately are as shown in FIGS. 9(A) and 9(B).

Figure 10:
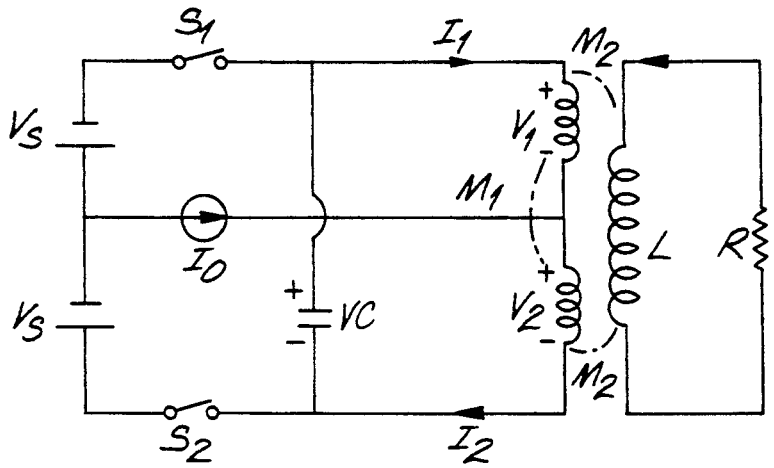
FIG. 10 is an equivalent circuit diagram with regard to the current source inverter of the present invention.

Operation of such inverter can be equivalently interpreted as FIG. 10, and this is interpreted as an equivalent circuit obtained in the case when a power supply current in square wave is applied to a parallel circuit of transformer, capacitor and load.

Here, when a fluorescent light is the resistance load, the transformer operates as a magnetic inductance and being interpreted as inductance L, capacitance C and resistance R.

Therefore, in FIG. 10, since current $I_O$ is $I_O=I_1-I_2$, voltage $V_C$ is $V_C=V_1+V_2$ $$V_C = V_C(t) - Ee^{-\frac{1}{8RC}}\sin(\omega t)$$
$$= L\frac{dV_3}{dt} + 2M_2\frac{dI_1}{dt} + RI_3 = 0$$

and $$C\frac{dV_C}{dt} = -I_2 = -I_1 + I_0$$

When arranging and solving above equation, it becomes $$V_C^{(t)} = Ee^{-\frac{1}{8RC}}\sin(\omega t)$$

Here, since input current $$I_O = \frac{\pi^2}{2R}E.$$

it is possible to select the switching element and transformer and other elements in response to the load variation.

And, initial starting operation can be switched by switches S1 and S2 through resonance coil $L_{dc}$ and resistor $R_S$ of FIG. 8 when input voltage is applied , and when one switch of these is operated, the other switch becomes OFF because inverse voltage is applied to the driving current.

At this moment, current $I_S$ flowing in said coil $L_{dc}$ is $$I_S = \frac{E}{R}(1 - e^{-\frac{1}{L_{dc}}t})$$

And, self oscillating operation is as follows.

When a sine wave voltage is applied to both ends of the transformer by said starting operation, switching operation of switches S1 and S2 can be done by these.

That is, in case when $V_C=O$, switching voltage $V_{VES1}$ between the base and emitter of transistor Q1 becomes plus + voltage larger than zero 0, and said transistor Q1 becomes ON.

At this moment, when the coil winding ratio of the transformer is n=1, the driving current of switching transistor $$I_{SD} = \frac{\left(1 - \frac{1}{n}\right)\frac{V_C}{2}}{R_S + R_B}$$

$$I_{SD} \text{ flows as } I_{SD} = \frac{\left(1 - \frac{1}{n}\right)\frac{V_C}{2}}{R_S + R_B}$$

Further, in turning on operation of the fluorescent light of said load, high voltage is required only when starting to turn it on, and once it is turned on, only power voltage is required, therefore, in practice, the output wave form of the transformer is applied as it is before the fluorescent light being turned on by connecting a tuning capacitor $C_S$ in serial with the fluorescent light as shown in FIG. 8, and once turned on, voltage over both ends of the fluorescent light can be selected pertinently by utilizing the voltage drop of both ends of the tuning capacitor.

Figure 11:
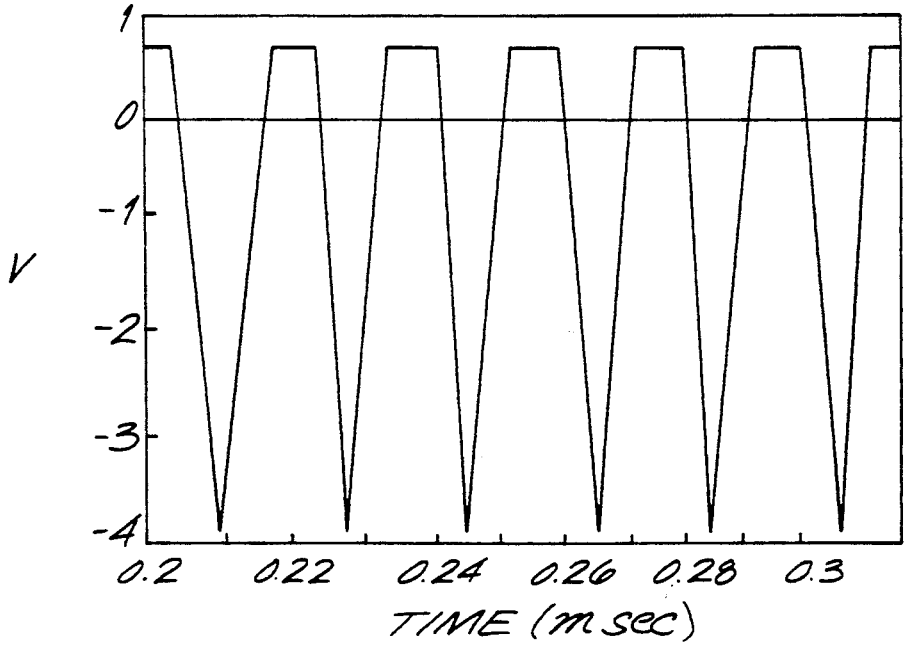
FIG. 11 is a wave form chart of switching transistor Q1 base voltage of the present invention.

FIG. 11 is the wave form of the base voltage of switching transistor Q1 showing that collector current of transistor Q1 is produced in selection of half period due to current wave form of the load is fed by sine wave, in which operation of inverter at this moment is exhibited by voltage in accordance with the ON/OFF of switching causing from voltage between base and emitter of said transistor Q1.

Figure 12:
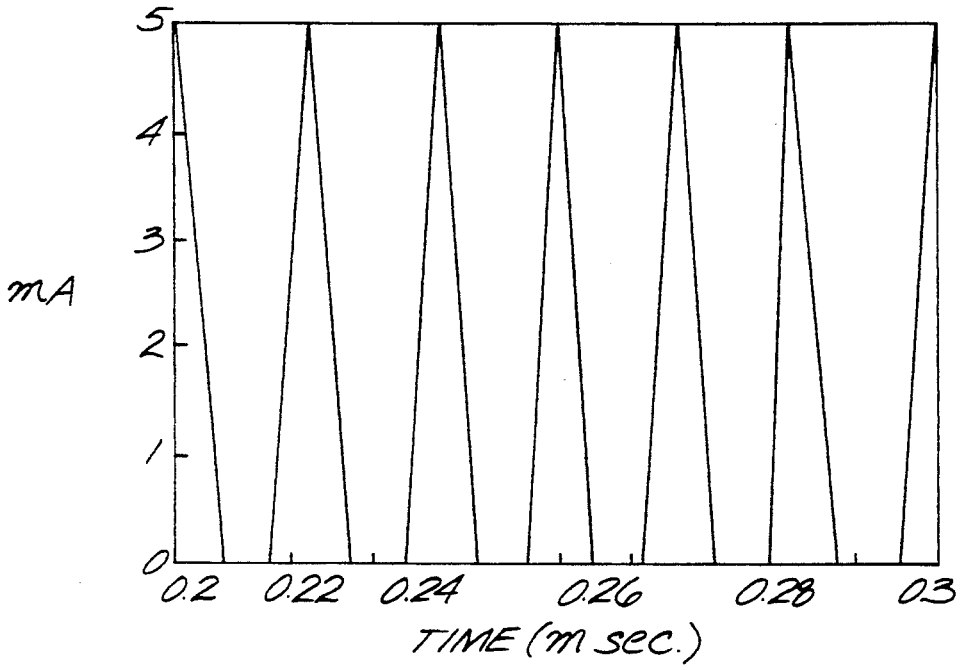
FIG. 12 is a wave form chart of switching transistor Q1 base current of the present invention.

Current wave form of the transistor Q1 at this moment is shown in FIG. 12.

Figure 13:
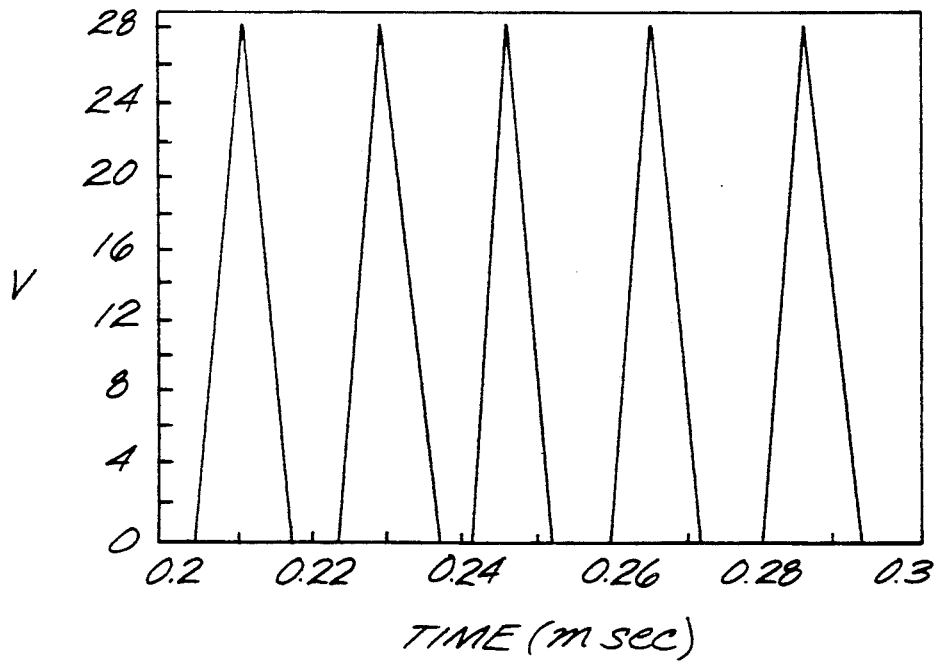
FIG. 13 is a wave form chart of switching transistor Q1 collector voltage of the present invention.

The switching operation of the transistor Q1 is produced at the zero crossing point of collector voltage as shown in FIG. 13.

As described above, the present invention has an effect capable of economically utilizing a small resonance type current source power supply device for eliminating noise and preventing switching stress and simultaneously reducing electrical power loss to a minimum with respect to the small fluorescent light turning on power supply device.

It will be appreciated that the present invention is not restricted to the particular embodiment that has been described hereinbefore, and that variations and modifications may be made therein without departing from the spirit and scope of the invention as defined in the appended claims and equivalents thereof.

What is claimed is:

1. A power supply for a fluorescent light for a liquid crystal display comprising:

a d.c. power source;

a transformer having a center tap primary and having its secondary connected to the leads of the fluorescent light;

a capacitor in series with the transformer secondary and the fluorescent light;

a pair of transistor switches having their emitters connected to the power source, the collectors of the transistor switches being connected to the ends of the primary of the transformer;

a capacitor connected across the collectors of the transistor switches;

a center tap filter coil;

a first resistor connecting one end of the filter coil to the base of one switching transistor;

a second resistor connecting the other end of the filter coil to the base of the other switching transistor;

a third resistor interconnecting the center tap of the filter coil and the center tap of the transformer; and a resonance coil interconnecting the power source and the center tap of the transformer primary through the third resistor.

2. A power supply for a fluorescent light for a liquid crystal display comprising:

a d.c. power source;

a transformer having a center tap primary and having its secondary connected to the leads of the fluorescent light;

a capacitor in series with the transformer secondary and the fluorescent light;

a pair of transistor switches having their emitters connected to the power source, the collectors of the transistor switches being connected to the ends of the primary of the transformer;

a capacitor connected across the collectors of the transistor switches;

a center tap filter coil;

a first resistor connecting one end of the filter coil to the base of one switching transistor;

a second resistor connecting the other end of the filter coil to the base of the other switching transistor; and means for producing a sine wave voltage in response to application of power from the d.c. power source and for feeding the sine wave voltage to the center tap of the filter coil, such that the sine wave voltage is applied to the bases of the transistor switches for turning on each of the switches at a crossing point of each collector voltage.

3. The power supply of claim 2 wherein the means for producing comprises:

a third resistor for interconnecting the center tap of the filter coil and the center tap of the transformer; and a resonance coil for interconnecting the power source and the center tap of the transformer primary through the third resistor.

* * * * *

UNITED STATES PATENT AND TRADEMARK OFFICE

CERTIFICATE OF CORRECTION

PATENT NO. : 5,121,032

DATED : June 9, 1992

INVENTOR(S) : Kwanyoung Han

It is certified that error appears in the above-identified patent and that said Letters Patent is hereby corrected as shown below:

On the Front Page:

Assignee, change "Suwon, Kuwait" to -- Suwon, Korea --.

Abstract, line 6, after "consumption," insert -- a tuning --.

Column 3, line 53, change $$"V_C = V_C(t) - Ee^{-\frac{1}{8RC}} \sin(\omega t)"$$

to $$-- V_C = V_C(t) - Ee^{-\frac{1}{8R_C}} \sin(\omega t) --.$$

Column 3, delete lines 54-66 in their entirety.

Column 4, line 35, delete the formula.

Signed and Sealed this

Thirty-first Day of August, 1993

Bruce Lehman

*Attest:*

BRUCE LEHMAN

*Attesting Officer*

*Commissioner of Patents and Trademarks*